United States Patent [19]

Shibata

[11] Patent Number: 4,665,844

[45] Date of Patent: May 19, 1987

[54] CURVED CLOTH STRETCH FRAME CONSTRUCTION FOR AN EMBROIDERY SEWING MACHINE

[75] Inventor: Yoshio Shibata, Aichi, Japan

[73] Assignee: Kabushikikaisha Barudan, Japan

[21] Appl. No.: 697,557

[22] Filed: Feb. 1, 1985

[30] Foreign Application Priority Data

Feb. 2, 1984 [JP] Japan ..... 59-18879
May 23, 1984 [JP] Japan ..... 59-1014134

[51] Int. Cl.[4] ..... D05C 9/04
[52] U.S. Cl. ..... 112/103; 112/121.11
[58] Field of Search ..... 112/103, 113, 121.26, 112/121.27, 63, 121.15, 121.12, 121.11

[56] References Cited

U.S. PATENT DOCUMENTS 3,448,707 6/1969 Thomsen ..... 112/63 X
3,799,085 3/1974 Webber ..... 112/121.12
3,810,414 5/1974 Gerber ..... 112/121.12 X
3,842,766 10/1974 Connor, Jr. ..... 112/121.12
3,905,315 9/1975 Sasaki ..... 112/103 X
4,208,975 6/1980 Teetz ..... 112/103 X
4,467,733 8/1984 Martin ..... 112/63 X
4,503,790 3/1985 Keeton ..... 112/121.26 X

*Primary Examiner*—H. Hampton Hunter
*Attorney, Agent, or Firm*—William A. Drucker

[57] ABSTRACT

A curved cloth stretch frame device for an embroidery sewing machine comprises a substantially cylindrical frame body with an embroidery window, a reciprocation transmission to transfer the frame body axially and a rotation transmission to rotate the frame body. A curved cloth workpiece, such as the arm of a shirt, is put into the frame tightly. The frame is driven axially and in rotation and a wide curved area of the workpiece can be embroidered continuously.

8 Claims, 26 Drawing Figures

14
16
10
12
23
14
24
14
20
24
22
10'
21a
21b
21c
21
6
42
44
3
18
19
17
4
15
11
13
5
4
45
46
46a
25a
25
13
13
38
37a
37b
37
37c
28b
34
32
37b
40
41
39
28b
28c
35
36
26
33
28
30
31
29
29
28a

CURVED CLOTH STRETCH FRAME CONSTRUCTION FOR AN EMBROIDERY SEWING MACHINE

BACKGROUND OF THE INVENTION

1. Field of the Invention

The present invention relates to a workpiece holding frame for cloth articles to be embroidered on a sewing machine, such as caps, arms of undershirts and other garments having sleeve shape or curved cloth to be worked.

2. Description of the Prior Art

Flat cloth to be worked is commonly stretched over an annular tambour. A core, having a diameter smaller than the tambour is engaged and pressed against the cloth. The cloth is held between the inner surface of the tambour and the outer surface of the core to be kept tightly stretched. The tambour is transferred longitudinally and shifted transversely in a plane through a drive means linked with a connection means to cooperate with the tambour. The tambour system is, however, unsuitable for embroidering curved cloth workpieces such as on a cap with a visor. A tambour of restricted diameter can be used to work a cylindrical workpiece, such, for example, as the arm piece of an under garment, because space to accommodate a shuttle must be provided inside the workpiece. Thus with prior art devices, only a small area of the cloth can be prepared for continuous embroidery when the cloth is not flat.

SUMMARY OF THE INVENTION

It is an object of the invention to embroider curved non-planar cloth workpieces continuously over a wide area.

A stretch frame device is provided for feeding cloth to a sewing machine. The frame body has a cylindrical outer surface which fits inside a sleeve shape curved cloth workpiece. The frame body may be assembled from multiple separable frame sections.

It is also an object of the invention to provide a frame which transmits delicate embroidery movements.

DESCRIPTION OF THE EMBODIMENTS

Figure 1:
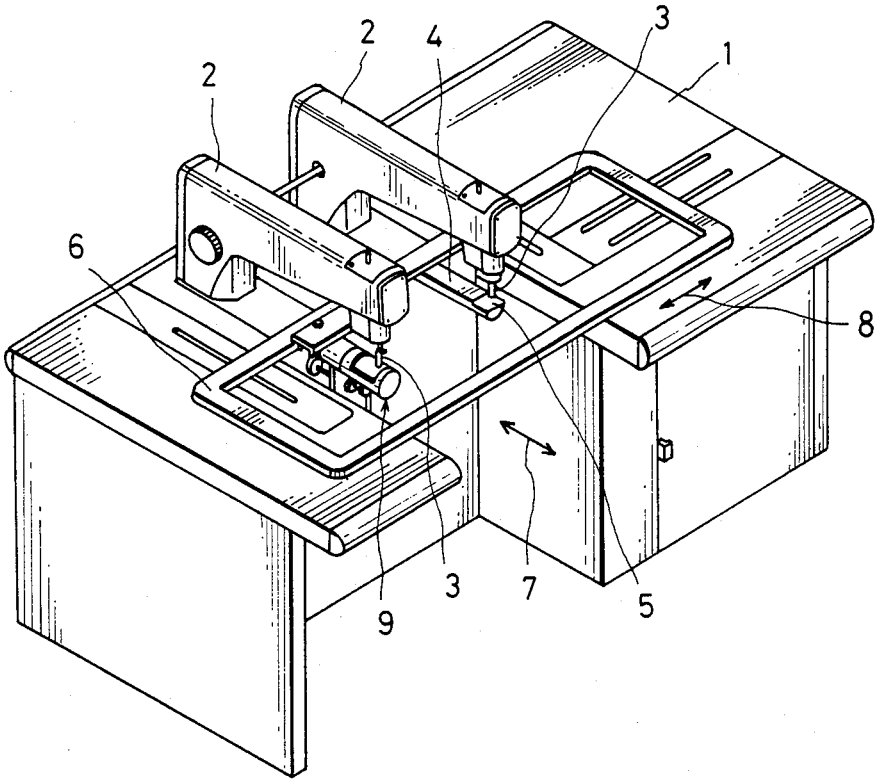
FIG. 1 is a perspective view of a complete sewing machine installation.

With reference to the Drawing, the invention is hereinafter described in working detail. FIGS. 1–14 show the best mode presently known for carrying out the invention. FIGS. 15–24 illustrate other embodiments of the invention.

Figure 2:
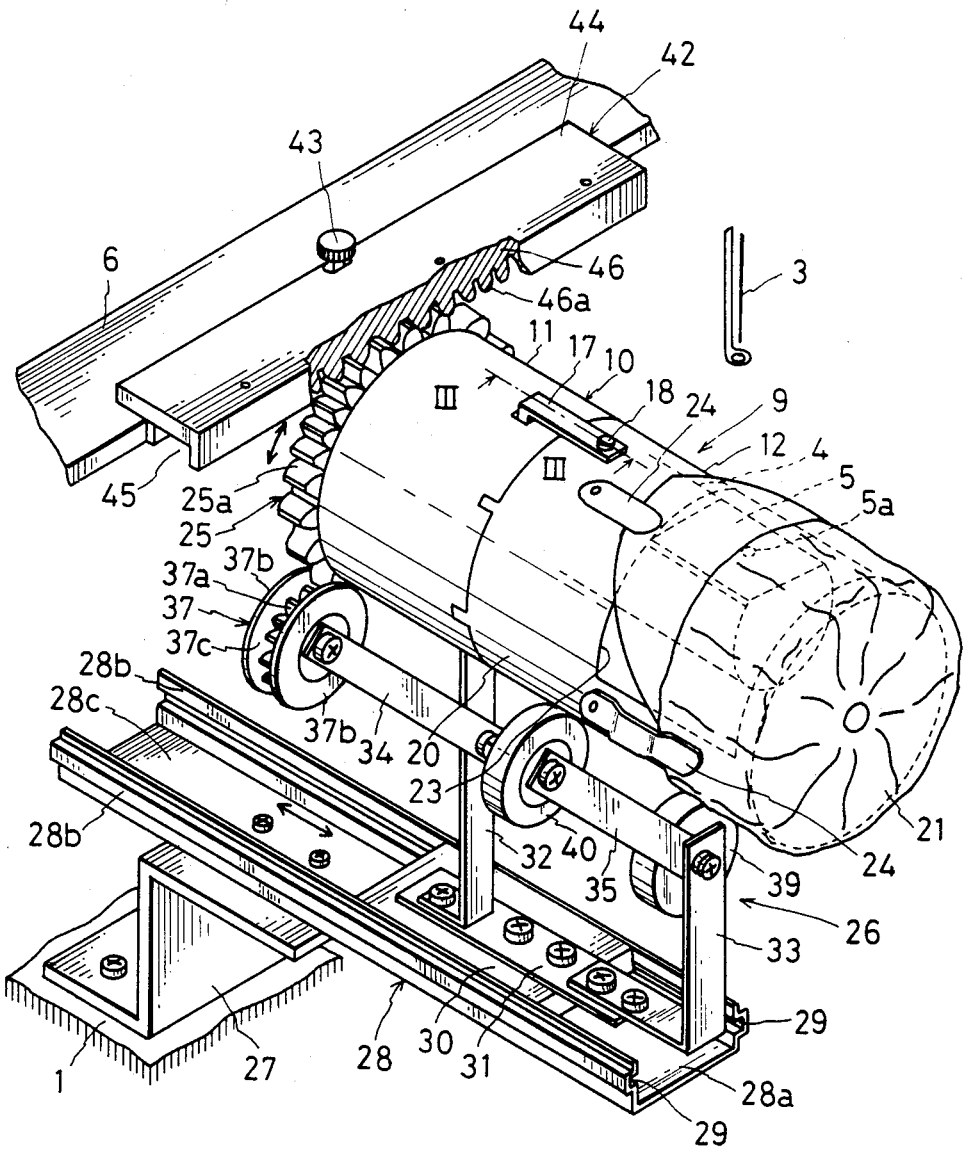
FIG. 2 is a perspective view of a curved cloth stretch frame construction.
Figure 5:
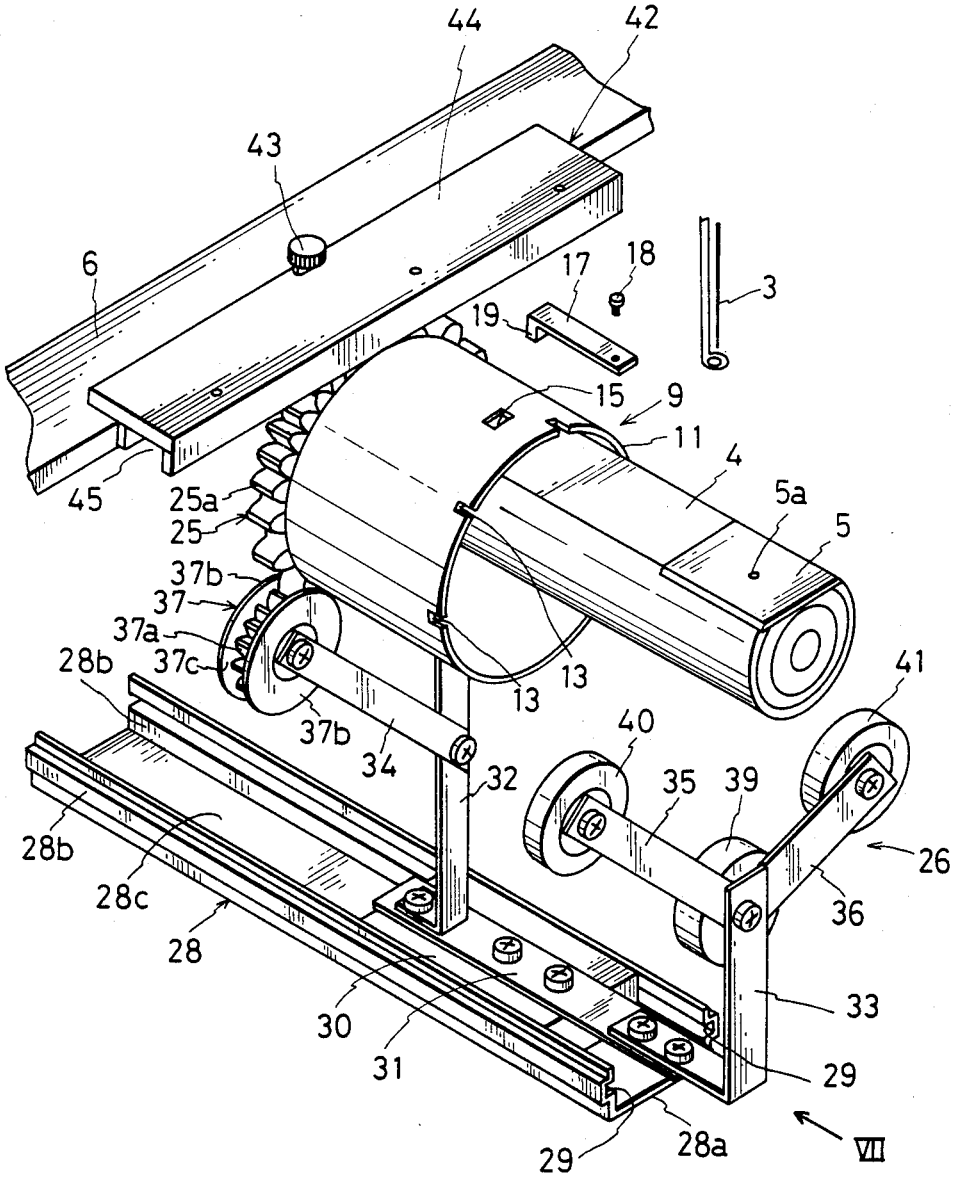
FIG. 5 is a perspective view of the frame construction in FIG. 2 with a second frame section taken away.

In FIG. 1 is an embroidery sewing machine on which a pair of heads 2 are mounted over a work table 1. Although two heads are shown, one head or more than two heads may be used. A conventional stitch needle 3 is mounted for vertical movement at the front of the head 2. A bed 4 is placed under the head 2 and the rear of the base of the bed 4 is secured to the work table 1. The front of the bed 4 is provided with a needle plate 5 which has a needle hole **5*a* opposite the needle 3, as seen in FIGS. 2 and 5. A known shuttle is inside the bed 4**.

A preprogrammed movable frame 6 on the work table 1 is moved in the direction of the arrow 7 forward and backward and from side to side in the direction of the arrow 8 by a transfer device (not shown). A curved cloth stretch frame 9, constructed as in FIGS. 2 to 6, is positioned over the bed 4. The stretch frame 9 is transferred forward and backward with the front and rear transfer of the movable frame 6 and is axially rotatable in response to shift of the frame 6. Although the stretch frame 9 is seen in FIG. 1 with only one bed 4, the other bed is provided with another frame 9.

When the curved cloth stretch frame 9 is not used on the embroidery sewing machine conventional operation is possible with a tambour attached to the movable frame 6.

Figure 3:
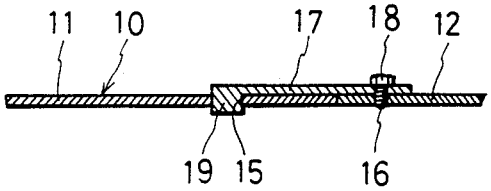
FIG. 3 is a section along line III—III of FIG. 2.

The frame body 10 of the curved cloth stretch frame 9 is made in the shape of a hollow cylinder. This consists of a first frame section 11 at the rear base side and of a second frame section 12 at the front end side. The two frame sections are formed by a rectangular plane dividing the frame 9 along the axis. A plurality of keying connection slots 13 are formed at the front end of the first frame section 11. Keying connection lugs 14 are formed at the rear end of the second frame section 12. The lugs 14 are inserted in the slots 13 with sectional axes aligned to prevent relative rotation between the sections. A coupling hole 15 is formed in the first frame section 11. A threaded hole 16 is formed in the second frame section 12. A resilient connection piece 17 is fixed to the outer surface of the second frame section 12 by a fastening screw 18 inserted in the threaded hole 16. The end of the connection piece 17 includes a projection 19 which extends towards the axis of the frame body 10 as seen in FIG. 3. The projection inserts in the couple hole 15 and the frame sections 11,12 are prevented from axial separation. A plurality of connection pieces may be used.

Figure 8:
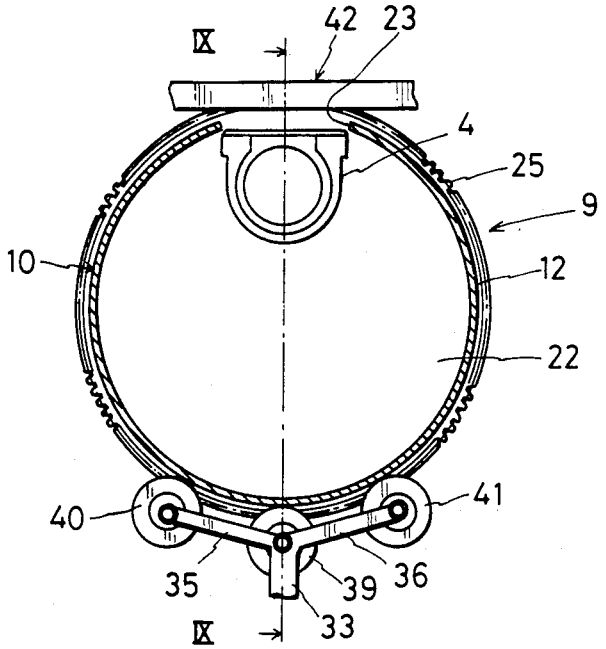
FIG. 8 is a section along line VIII—VIII in FIG. 9.
Figure 9:
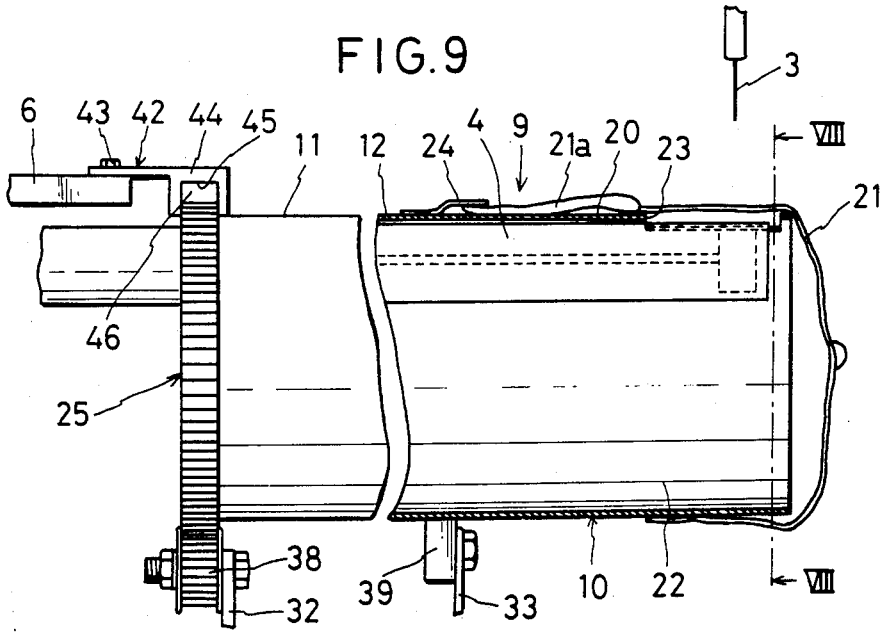
FIG. 9 is a section along line IX—IX in FIG. 8.

The outer surface of the frame body 10 is formed as a curved cloth stretch surface 20, the upper half of which is of a semi-cylindrical form with an arcuate cross section around the axis of the frame body 10. As an example of a cloth workpiece to be embroidered as a curved cloth the internal side surface of a cap 21 is illustrated. The surface 20 is shown, in the figure, as a circular cylindrical surface, but it may be a polygonal cylindrical surface consisting of several planar areas. The cap 21 can be easily put on the frame body 10 from the front free end side. The inside of the frame body 10 is a space 22 in which the bed 4 is disposed as seen in FIGS. 8,9. The space 22 is large enough so that the frame body 10 may rotate by a prescribed angle around the axis thereof with the bed 4 disposed therein. A window opening 23 is provided in the curved cloth stretch surface 20. The embroidery window 23 accommodates the stitch needle 3 from the frame body 10 towards the bed 4. A resilient fastener 24 is secured to the surface of the outer frame section 12 to clamp the workpiece such as the cap 21. A plurality of fasteners 24 may be attached to the frame section 12. A drive transmission in the form of a toothed wheel 25 on the outer surface of the section 11 includes plural teeth **25*a* which project from the surface of section 11. The wheel 25 is a principal part of a means to rotate the first frame section 11 along the curved cloth stretch surface 10**. It is also part of the axial transfer means of the first frame section. The rotation transmission and the reciprocation transmission may be provided as separate units.

Figure 7:
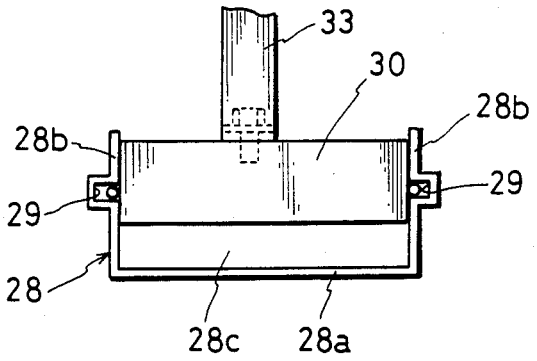
FIG. 7 is a view along an arrow VII in FIG. 5.

A frame support means 26 for the stretch frame 9 functions during both rotation around and reciprocation along the axis of the frame 9. The support 26 comprises a bracket 27 fixed to the work table 1, as seen in FIG. 2. A guide rail 28 is mounted on the bracket 27. A guide groove **28*c* is formed by a bottom wall or floor 28*a* and side walls 28*b*. The groove 28*c* is disposed in the direction of the front and rear movement of the movable frame 6. On the inner sides of the walls 28*b*, there is a horizontal slot 29. A slider 30 moves longitudinally in the groove 28*c* along the slots 29 as seen in FIGS. 5,7**.

A mounting plate 31 is fastened to the slider 30. Support poles 32 and 33 are fitted on the plate 31. A support arm 34 is fixed to the support pole 32. Support arms 35 and 36 are fixed to the support pole 33. A grooved gear wheel 37 is rotatably mounted on the support arm 34 which consists of a gear **37*a* and of a pair of flanges 37*b* attached to both sides of the gear 37*a*. The gear 37*a* is formed to engage the toothed wheel 25. The wide of a groove 37*c* is defined by flanges 37*b* and is adjusted to receive the wheel 25. Another grooved gear wheel 38 of similar construction is mounted rotatably on support pole 32. A roller 39 is rotatably supported on pole 33. Rollers 40 and 41 are respectively rotatably mounted on support arms 35 and 36. The rollers 39,40,41 support the lower side surface of the second frame section 12 seen in FIG. 8. The stretch frame 9 is supported with the wheel 25 in mesh with gear wheels 37 and 38. The bottom of frame section 12 rests on rollers 39,40,41 as seen in FIGS. 8 and 9**.

Figure 10:
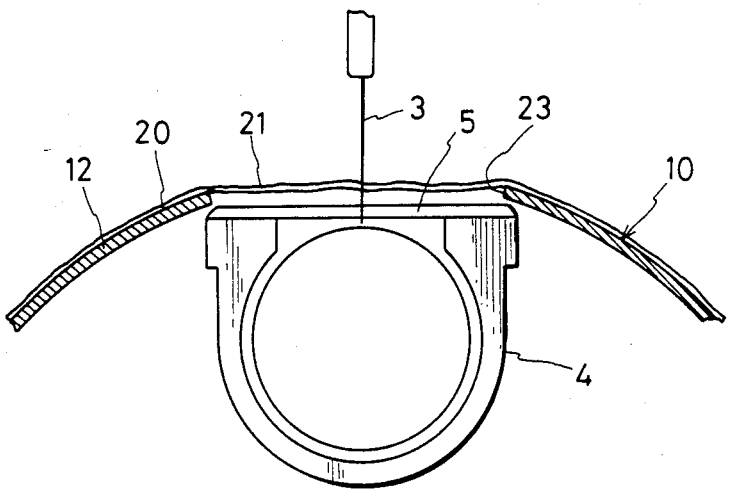
FIG. 10 is an enlarged view of the essential construction in FIG. 8.
Figure 11:
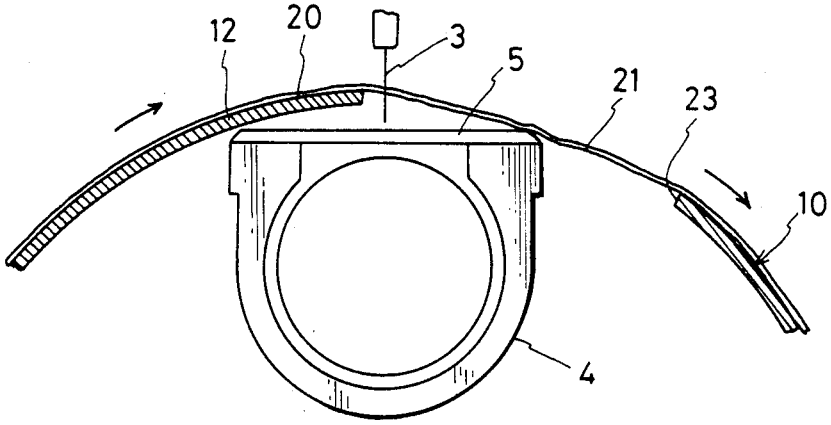
FIG. 11 is a sectional view showing the operation of FIG. 10.

The bed 4 is at the upper part of the space 22 and the top surface of the needle plate 5 is moved close to the stretch surface 20 as seen in FIGS. 10 and 11.

The transmitting frame 42 is attached to the movable frame 6 by a mounting screw 43 and rotates the stretch frame 9 around the axis thereof and transfers the frame back and forth along the axis according to the movement of the frame 6. The frame 42 includes a frame base 44 and a slide duct or groove 45 which is formed in the frame base 44 and is mounted to engage over the toothed wheel 25 as a pinion. A toothed rack 46 is formed in the lower surface of the groove 45 and is provided with rack teeth **46*a* which engage the toothed pinion wheel 25. The pinion 25 is driven by the gears 37,38 along the groove 45 as seen in FIGS. 2 and 9 when the rack 46 engages the pinion 25**.

EXAMPLE 1

A curved cloth workpiece such as the side surface of a cap 21 is embroidered on the curved cloth stretch frame device hereintofor described according to the following operation of the machine.

Figure 4:
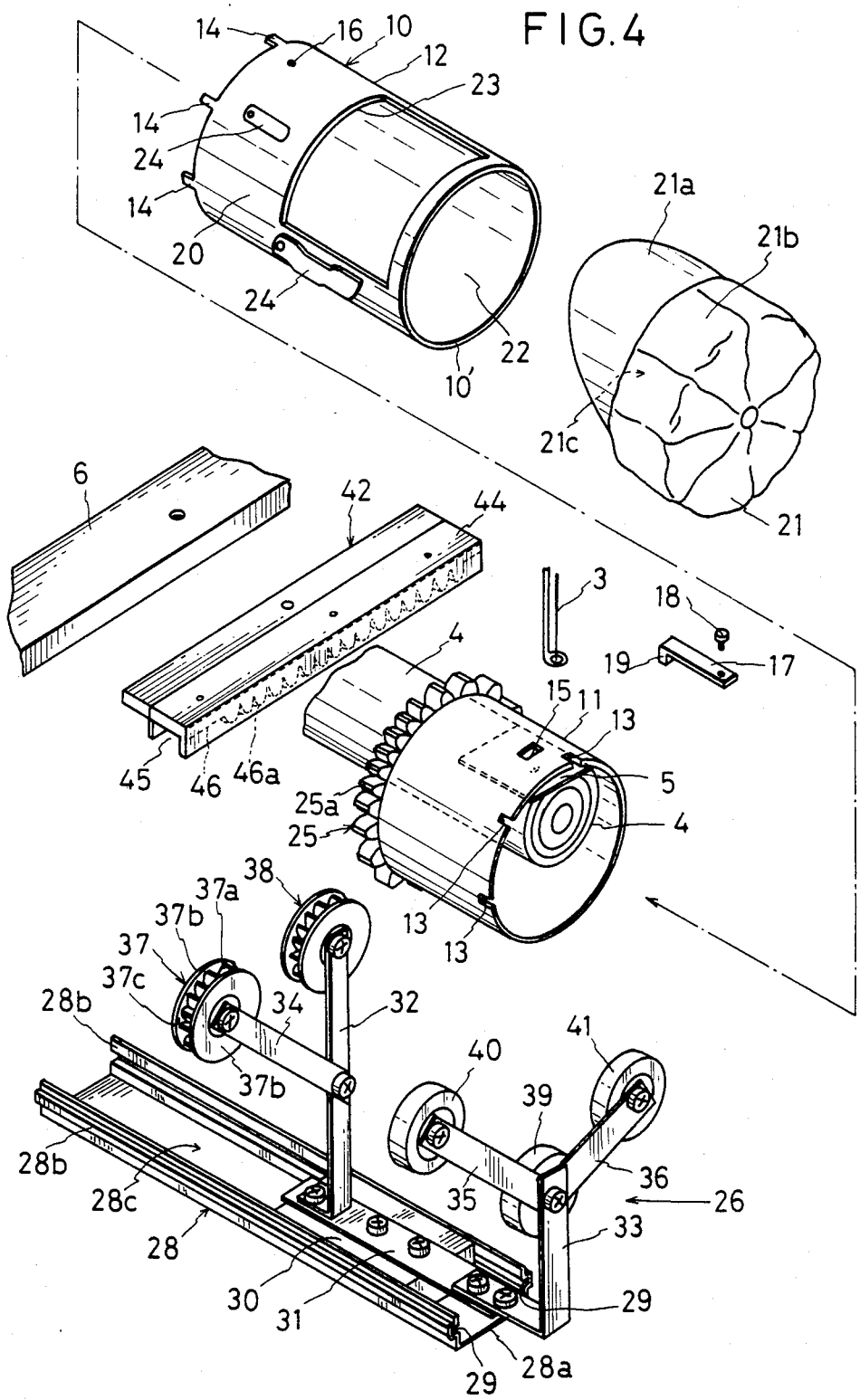
FIG. 4 is a fragmentary view of a frame construction in FIG. 2.
Figure 6:
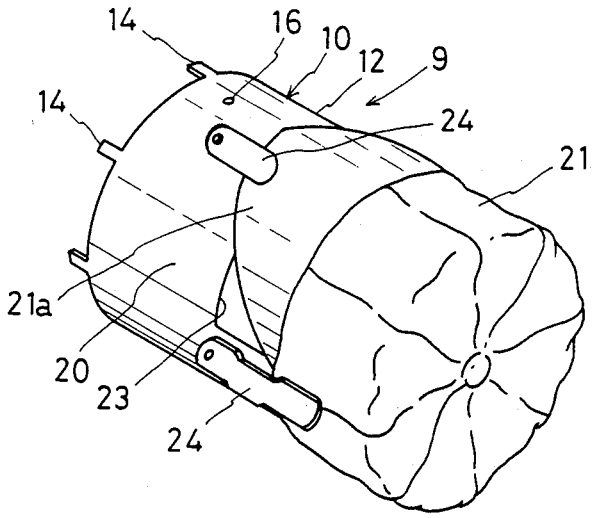
FIG. 6 is a perspective view of the second frame section with a cap thereon.

The connection piece 17 is disconnected from couple hole 15. The frame section 12 of the stretch frame 9 is separated from frame section 11 as seen in FIG. 4 and the cap 21 is put on the seprated section 12. The cap 21 is on the free end of section 12 as seen in FIG. 6. An area of the cap 21 to be embroidered is brought to the window 23 and is abutted on the stretch surface 20. The edge of the cap 21 is held by the fastener 24 on the outer side surface of the second frame section 12 and the visor **21*a* is also secured by a fastener 24 to stabilize the cap 21. The connection projection lug 14 of the second frame section 12 fits into the slot 13 of the first frame section 11 as seen in FIG. 4. The projection 19 on the connection piece 17 fits in the hole 15. The second frame section 12 is thereby joined to the first frame section 11 as seen in FIG. 2. After the first frame section 11 and the second frame section 12 are assembled the embroidery area of the cap 21, stretched on the window 23, is placed directly over the needle plate 5 of the bed 4 and under the needle 3. When the sewing machine is in operation, the vertically moving needle 3 stitches thread onto the embroidery area of the cap 21 and the movable frame 6 is driven back and fourth, right and left according to a pre-programmed embroidery pattern. When the movable frame 6 is driven back and fourth in this way, the curved cloth stretch frame 9 shifts back and forth with the slider 30 travelling back and forth along the slots 29. The pinion wheel 25 on the stretch fra-e 9 is in the duct 45 of the frame 42 and engages the gears 37 and 38. When the movable frame 6 is driven right and left the frame 9 rotates and the pinion wheel 25 is rotated by the rack 46. The curved stretch frame 9 is supported on rollers 39,40,41 and the gear wheels 37,38. The pinion wheel 25 engages the gears 37,38 and is in mesh with the rack 46*a* of the frame 42. The embroidery area on the cap 21 which extends across the window 23 is transferred back and forth by the motion of the frame 6 and is also shifted left and right by movement of frame 6 as seen in FIGS. 10 and 11. When multiple second frame sections 12 are prepared, mounting a second cap on a second frame section 12 efficiently while a first cap is being embroidered on the sewing machine. Alternatively the cap 21 may be put onto the second frame section 12 already assembled with the first frame section 11 as seen in FIG. 11**.

EXAMPLE 2

Figure 12:
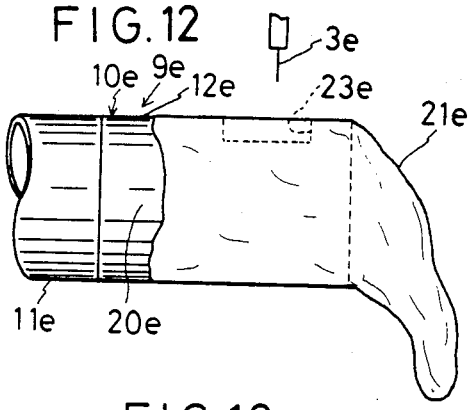
FIG. 12 is a view of a stocking being embroidered.

FIG. 12 shows how an elastic stocking is embroidered. The stocking 21*e* is mounted on the free front end of the frame body 10*e* by self elasticity. Thus the elastic character of the workpiece serves to clip the stocking 21*e* onto the curved cloth stretch frame 9*e*.

Equivalent members are identified by the same reference character plus a suffix e. Reference numbers in following figures are identified as equivalent by successive alphabetical suffices f, g, h, i, j, k and l to avoid repetitious descriptions of equivalents.

EXAMPLE 3

Figure 13:
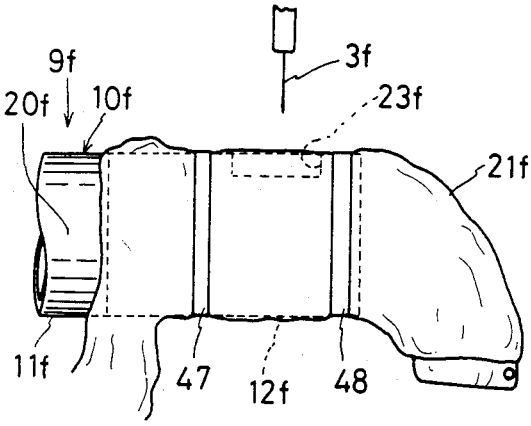
FIG. 13 is a view of the arm of a shirt being embroidered.

FIG. 13 shows a long cylindrical workpiece, e.g., an arm 21*f* of a shirt, being embroidered. The arm 21*f* is fastened to the stretch surface 20 at both sides of the frame 23*f* by a pair of rubber bands 47,48 after the arm has been adapted to the frame body 10*f* and the embroidery area correctly positioned on the window 23*f*.

EXAMPLE 4

Figure 14:
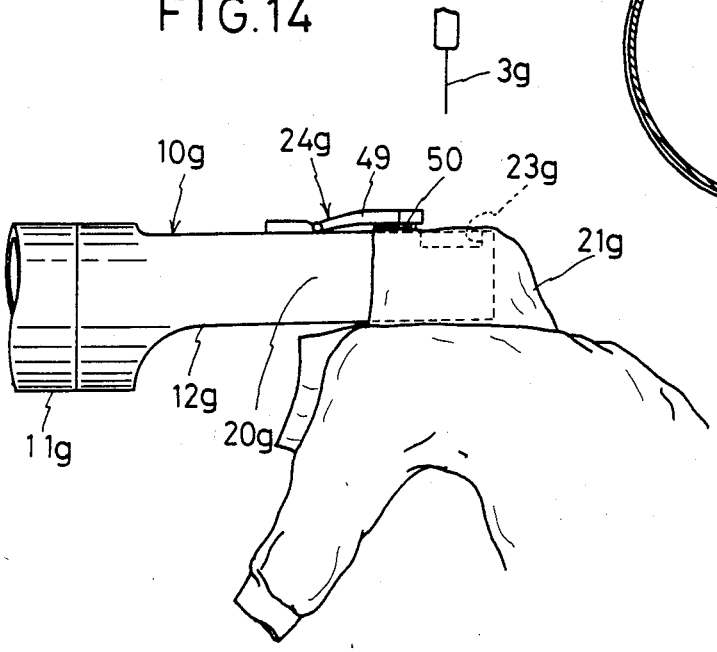
FIG. 14 is a view of a shirt breast pocket being embroidered.

FIG. 14 shows an emblem being embroidered on a breast pocket. The free end of the frame body 10*g* is made thinner than usual so as to be easily inserted in the pocket 21*g*. An auxiliary piece 49 of the fastener 24*g* pivots vertically and is biased by a spring (not shown) so that the tip of the fastening piece 49 may be pressed down. A needle cloth 50 is attached under the tip of the fastening piece 49 to clip the cloth workpiece. The fastening piece 49 may alternatively be a spring plate attached on the frame body 10*g*.

EXAMPLE 5

Figure 15:
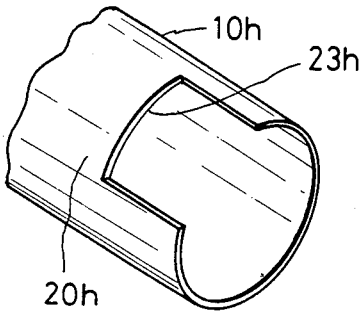
FIG. 15 is a perspective view of a second embodiment of an embroidery window.

FIG. 15 shows another embodiment of the embroidery window. The window 23*h* is provided as a slot extended to the free end of the frame body 10*h*.

EXAMPLE 6

Figure 16:
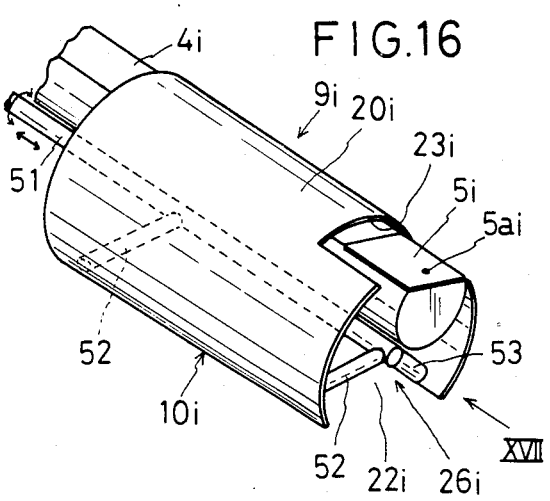
FIG. 16 is a perspective view of said second embodiment of a curved cloth stretch frame construction.
Figure 17:
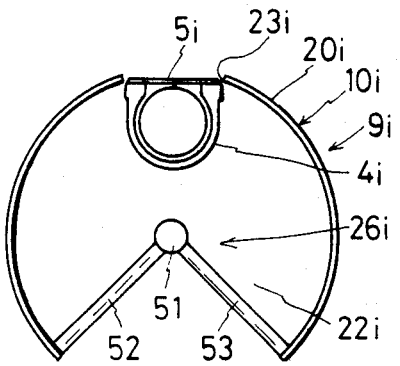
FIG. 17 is a view along an arrow XVII in FIG. 16.
Figure 18:
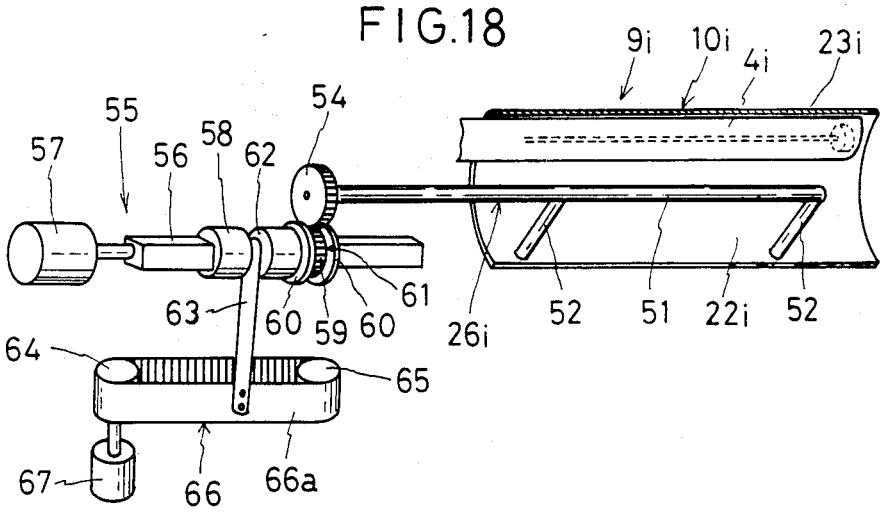
FIG. 18 is a perspective view of a drive means for the frame construction of FIG. 16.

FIGS. 16 to 18 show a further embodiment of the stretch frame construction including alternative frame support means and drive means. The frame 9*i* in this embodiment comprises the body 10*i* in the form of an incomplete cylinder with the lowest quarter of the side wall cut away longitudinally. The frame 10*i* is a single member and the upper surface thereof is a semi-cylindrical curved cloth stretch surface 20*i*. The frame support means 26*i* for the stretch frame 9*i* is an elongated bar 51 supported for rotation and axial transfer be bearing means (not shown). Arms 52,53 are fixed to the bar 51 at one end and onto the frame body 10*i* at the other end to serve as a connection piece for axial reciprocation and for rotation. Pairs of support arms 52,53 are disposed at axial points on the bar 51. The frame body 10*i* is supported around the bar 51 by the arms 52,53. The bar 51 is disposed to cross the center of curvature of the external surface of the frame body 10*i*. A gear wheel 54 is mounted on one end of the bar 51 and is rotated and axially transferred by a drive 55. In the drive 55 a guide rod 56 of rectangular cross section is rotatably supported in parallel with the support bar 51 by bearing means (not shown) and is rotated by an electric motor 57 in forward and reverse directions. A transfer member 58 is fitted on the rod 56 for axial slide movement and is provided with a gear 59 on the outer surface thereof. Flanges 60 are formed on both sides of the gear 59. A groove 61 is defined between the flanges 60. The gear 54 engages in the groove 61 and is in mesh with the gear 59. A neck 62 on one side of the transfer member 58 cooperates with rod 63. An endless timing belt 66 passes around a pair of pulleys 64,65. One transfer side 66*a* of the timing belt 66 is parallel with the rectangular guide rod 56 and the end of the rod 63 is attached to this transfer side 66*a*. One of the pulleys 64 is rotated by another electric motor 67 in forward and reverse directions. The motor 57,67 operate according to an embroidery pattern via control means.

The electric motor 57 operates first to rotate the rectangular guide rod 56. The transfer member 58 and the gear 59 are then actuated to rotate the gear 54 and the support bar 51. The stretch frame 9*i* is thereby rotated to shift the cloth work right and left. The motor 67 turns the timing belt 66. The rod 63 is then shifted forward and backward to slide the members 58 forward and back. The bar 51 and the frame 9*i* are thereby shifted forward and backward to shift the cloth workpiece forward and back.

EXAMPLE 7

Figure 19:
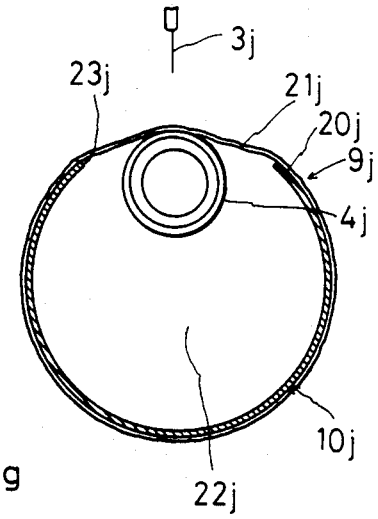
FIG. 19 is a sectional view of a third embodiment of a frame and of the bed of the sewing machine.

FIG. 19 shows another embodiment of the stretch frame and bed. The frame 9*j* consists of the frame body 10*j*, having the form of an incomplete circular cylinder with the upper wall cut away longitudinally. The bed 4*j* has a circular cross section. The curved cloth workpiece 21*j* stretched on the frame body 10*j* is transferred while in contact with the upper surface of the bed 4*j* in the embroidery window 23*j*.

EXAMPLE 8

Figure 20:
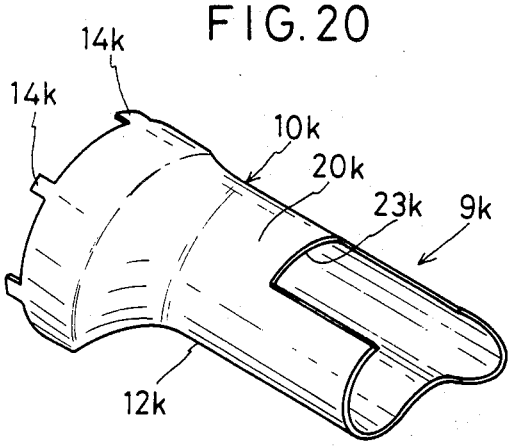
FIG. 20 is a perspective view of a fourth embodiment of the frame.
Figure 21:
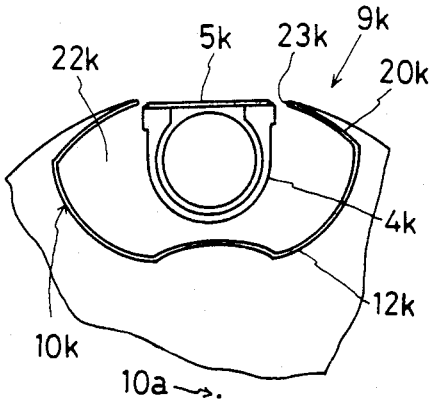
FIG. 21 is a front elevational view showing the relation between the frame in FIG. 20 and the machine bed.
Figure 22:
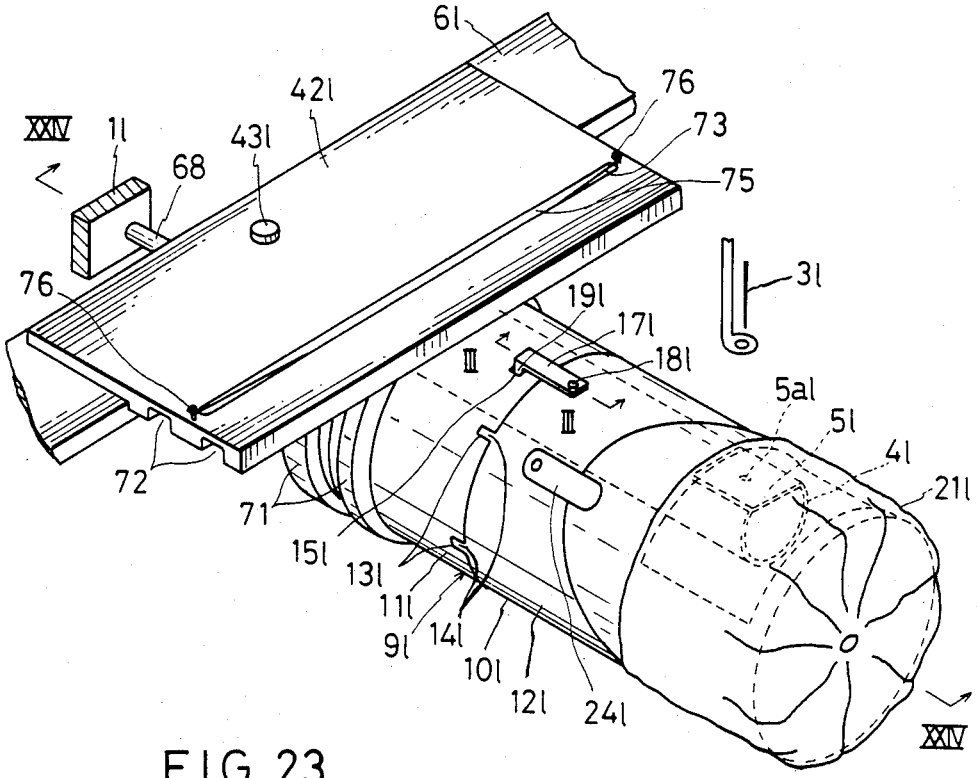
FIG. 22 is a perspective view of a fifth embodiment of frame construction.
Figure 23:
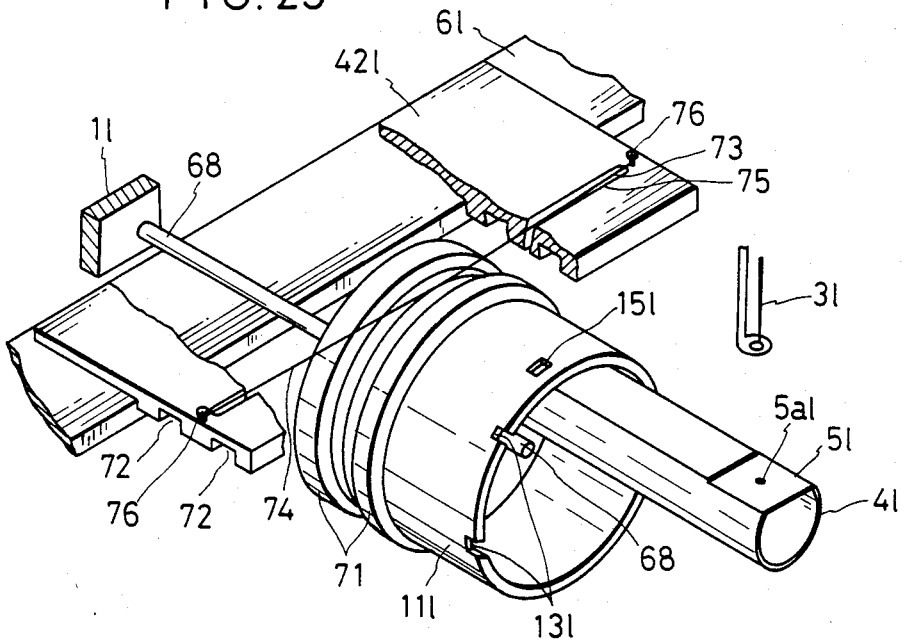
FIG. 23 is a perspective view of the contruction in FIG. 22 with some parts broken away.
Figure 24:
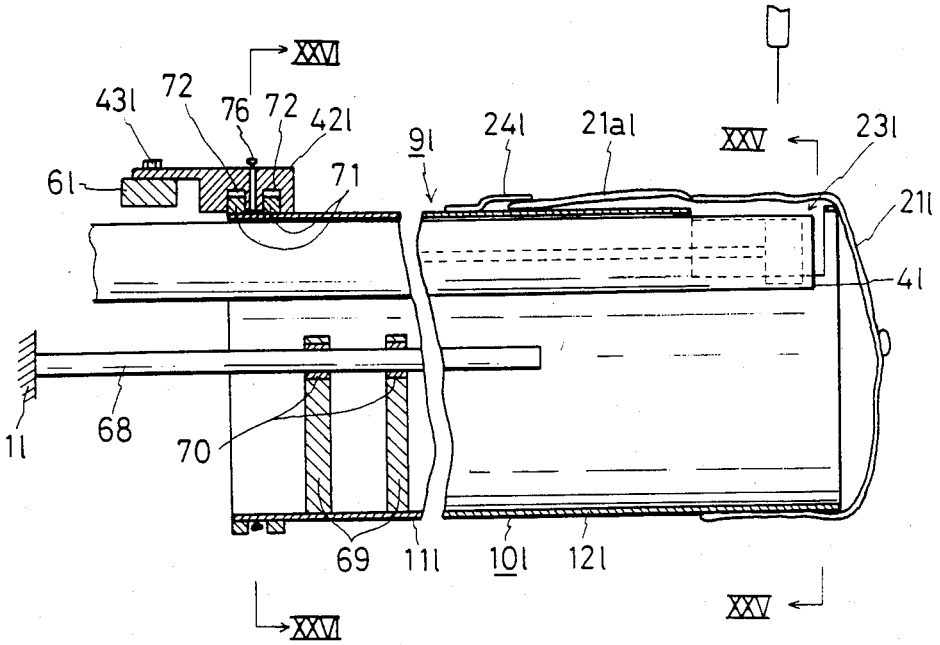
FIG. 24 is a section along line XXIV—XXIV in FIG. 22 with some parts omitted.
Figure 25:
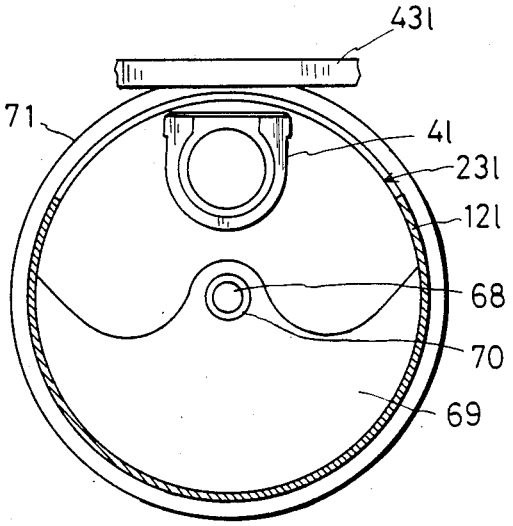
FIG. 25 is a section along line XXV—XXV in FIG. 24.
Figure 26:
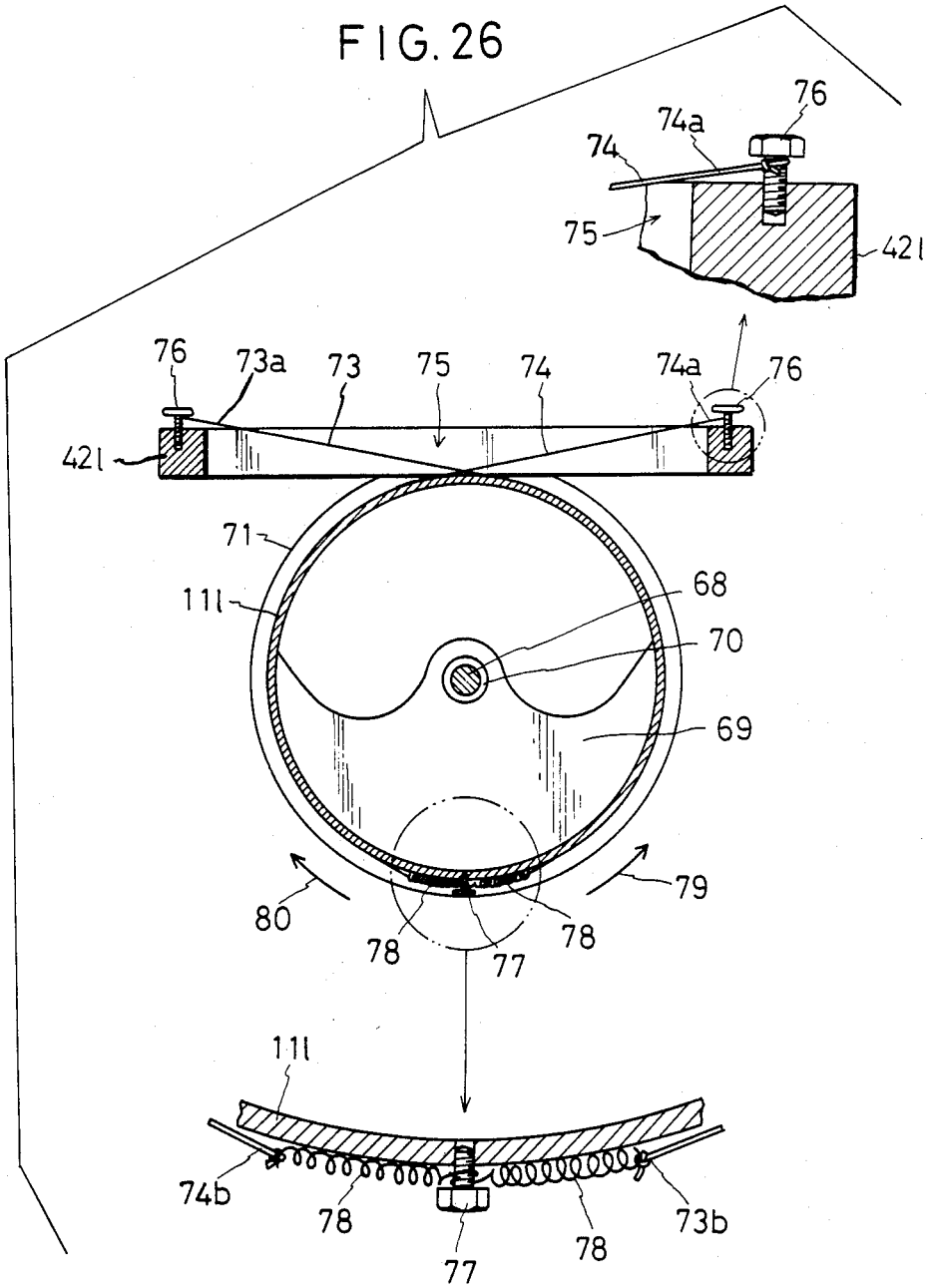
FIG. 26 is a section along line XXVI—XXVI in FIG. 24.

FIGS. 20 and 21 show an embodiment of the stretch frame for embroidering slender cylindrical work such as a slender arm or breast pocket of a blouse for ladies.

The base portion of the frame 9*k* is similar to the showing in FIG. 6. The front end is even thinner. The cross section of the front end is formed by arcuate curves around the center of rotation 10*a* of the frame body as seen in FIG. 21. On rotation the frame 9*k* does not collide with the bed 4*k*.

EXAMPLE 9

FIGS. 22 to 26 show another embodiment of the curved cloth stretch frame construction. A support shaft 68 is fastened at one end to the work table 1*l*. A pair of support plates 69 are attached on the internal surface of the frame body 10*l* and have bearings along the axis of the frame body 10*l*. The shaft 68 is journalled in bearings 70 for rotation and axial movement. A pair of flanges 71 are attached to the rear end portion of the frame body 10*l*. On the underside of the frame 42*l* are two grooves 72 in which flanges 71 are engageably fitted. A pair of cords 73,74 transmit torque drive and are passed crosswise in opposite directions around the frame body 10*l* from the transmitting frame 42*l* through a passage slot 75. The ends 73*a*,74*a* of the cords 73,74 are attached to the transmitting frame 42*l* by screws. The opposite ends of said string members 73,74 pass along the outer surface of the first frame section 11*l* in opposite directions. They are connected to a screw terminal 77 inserted in the first frame section 11*l* via tension springs 78. The cords 73,74 are always kept under tension. The cords 73,74 are preferably of low elasticity such as wires. The sum of the lengths of the cords 73,74 over the outer surface of the first frame section 11*l* is preferably adjusted to equal the circumference of section 11*l*. The sum, however, may be smaller (a length sufficient to realize a required angle of revolution) or larger (several times the circumference).

The operation of the above embodiment is as follows. When the movable frame 6*l* is shifted back and forth, the stretch frame 9*l* is similarly shifted back and forth together with the frame 6*l*. The flanges 71 of the stretch frame 9*l* are engaged in the grooves 72 of the frame 42*l*. When the movable frame is shifted right and left, the transmitting frame 42*l* is driven transversely to the axis of the stretch frame 6*l*. The movement of the frame 42*l* is transmitted to the stretch frame 9*l* through the cords 73,74 and the frame 9*l* is thus rotated left and right with respect to the central support shaft 68. When the transmitting frame 42*l* is driven to the left in FIG. 26, one end 73*a* of the cord 73 is pulled and moved to the left. The other end 73*b* of the cord 73 consequently pulls and turns the cloth stretch frame 9*l* in the direction shown by an arrow 79. When movement of the frame 42*l* is reversed to the right, the cord 74 rotates the stretch frame 9*l* in the reverse direction shown by an arrow 80. The cords do not appreciably slacken and the frame 42*l* can therefor rotate the frame 9*l* in opposition directions in response to reciprocation of the frame 42*l*.

It is an advantage of the present invention that in embroidering the curved side surface 21*b* of a non-planar article 21, the free end of the frame body 10 can be simply inserted in the end opening 21*c* of the workpiece. The embroidery area is stretched tightly on the curved cloth stretch surface 20 and the curved area can then be embroidered. This advantage is remarkable since the curved condition of the workpiece 21 is always maintained and thus the undistorted area can be embroidered broadly and neatly. It is another advantage of the present invention that when the direction of longitudinal movement of the frame 42*l* is reversed, the curved cloth stretch frame 9*l* which has just rotated in a first direction by the cord 73 is then at once returned in the opposite direction without slack play or delay by the cord 74. The delicate movement of the frame 42*l* around the turning point is transmitted faithfully to the curved cloth stretch frame 9l and any fine embroidery pattern can be correctly realized.

Since widely different embodiments of the present invention can be thought of without departing from the spirit and scope thereof, by those skilled in the art, it should be understood that the invention is not limited to the specific embodiments except as defined in the appended claims.

What is claimed is:

1. A sewing machine embroidery frame for a machine having a vertically reciprocating needle and a movable frame adapted to shift on a horizontal plane in two dimensions between said needle and a sewing machine bed comprising:

(a) a substantially cylindrical work support frame body having a free front end and a space within said body containing said sewing machine bed;

(b) an embroidery window formed in said body;

(c) axial drive reciprocation means cooperating with said body;

(d) rotational drive transmission means cooperating with said body;

(e) means operably connecting said axial and rotational transmission means to said movable frame and to said frame body;

(f) means stretching a curved cloth workpiece across said window; and (g) means supporting said body and window in rotation and axial transfer between said bed and said needle.

2. A frame as claimed in claim 1 in which said body comprises separate substantially cylindrical frame modules adapted to be separated from and connected to each other and an embroidery window formed in at least one module.

3. A frame as claimed in claim 1 in which axial and rotation transmissions comprise a rack secured to said movable frame and engaged in mesh with a pinion wheel mounted on said frame body for rotation around the axis of said frame body and for axial movement with said rack.

4. A frame as claimed in claim 1 in which the transmission means include grooves on said movable frame, flanges fixed on said frame body and a pair of cord members passed around said frame body in opposite directions and having an end fixed to said movable frame and an end fixed to said frame body, said flanges engaged in said grooves for rotation around said frame body and for movement with said frame body.

5. A frame as claimed in claim 1 comprising a cloth workpiece holding means on said frame body.

6. A frame as claimed in claim 1 in which the free front end of said frame body is tapered in reduced thickness.

7. A frame as claimed in claim 1 in which the window extends to the free front end of said frame body.

8. A curved cloth workpiece stretch frame device for an embroidery sewing machine having a vertically reciprocating stitch needle, comprising a substantially cylindrical hollow frame body and a sewing machine bed therein, an embroidery window formed in said body, a support bar along the axis of said body; and drive means operably connected to said bar, said bar being movable with respect to a sewing machine work table and said frame body being driven from said bar in rotation and reciprocation between said needle and said bed.

* * * * *